US006129511A

United States Patent [19]

Salvage et al.

[11] Patent Number: 6,129,511

[45] Date of Patent: Oct. 10, 2000

[54] METHOD AND APPARATUS FOR CONTROLLING INTERACTION BETWEEN VARIABLE GUIDE VANES AND VARIABLE DIFFUSER OF A CENTRIFUGAL COMPRESSOR

[75] Inventors: John W. Salvage, Jamesville; Joost J. Brasz, Fayetteville, both of N.Y.

[73] Assignee: Carrier Corporation, Farmington, Conn.

[21] Appl. No.: 09/179,698

[22] Filed: Oct. 27, 1998

[51] Int. Cl.[7] ..... F01D 17/16

[52] U.S. Cl. ..... 415/150; 415/1; 415/26; 415/48; 415/160

[58] Field of Search ..... 415/149.1, 150, 415/151, 159, 160, 165, 166, 1, 13, 17, 24, 26, 48, 49

[56] References Cited

U.S. PATENT DOCUMENTS

| | | | |
|---|---|---|---|
| 4,780,049 | 10/1988 | Palmer et al. | 415/36 |
| 5,873,696 | 2/1999 | Harada et al. | 415/148 |
| 5,927,939 | 7/1999 | Harada et al. | 415/17 |
| 6,036,432 | 3/2000 | Shishtla et al. | 415/26 |

*Primary Examiner*—Edward K. Look
*Assistant Examiner*—Liam McDowell
*Attorney, Agent, or Firm*—Wall Marjama Bilinski & Burr

[57] ABSTRACT

A method and apparatus for controlling the amount of gas flow through a compressor having variable geometry guide vanes and a variable geometry diffuser. The geometry variation of the diffuser is based on the geometry variation of the guide vanes. The method and apparatus ensure that the compressor will operate at peak efficiency over a broad range of load conditions.

7 Claims, 5 Drawing Sheets

METHOD AND APPARATUS FOR CONTROLLING INTERACTION BETWEEN VARIABLE GUIDE VANES AND VARIABLE DIFFUSER OF A CENTRIFUGAL COMPRESSOR

FIELD OF THE INVENTION

The present invention relates to a method and apparatus for controlling gas flow through a centrifugal compressor, and in particular, controlling interaction between variable guide vanes and a variable diffuser in a centrifugal compressor to maintain optimum performance of the compressor across a broad range of loads.

BACKGROUND OF THE INVENTION

One of the major problems arising in the use of centrifugal vapor compressors for applications where the compressor load varies over a wide range is flow stabilization through the compressor. The compressor inlet, impeller and diffuser passages must be sized to provide for the maximum volumetric flow rate desired. However, when there is a low volumetric flow rate through such a compressor, the flow becomes unstable. Specifically, as the volumetric flow rate is decreased from a stable range, a range of slightly unstable flow is encountered. In this range, there appears to be a partial reversal of flow in the diffuser passage, creating noise and lowering the compressor efficiency. Below this range, the compressor enters what is known as surge, wherein there are periodic complete flow reversals in the diffuser passage, destroying the efficiency of the compressor and endangering the integrity of its elements.

Most centrifugal compressors employed in refrigeration systems are designed to rotate at a fixed operating speed. Capacity control of the machine is normally accomplished by varying the position of a series of adjustable guide vanes located at the inlet of the machine. The mass rate of flow of refrigerant delivered to the impeller is thus varied to meet the changing load demands made on the machine. At maximum flow, the refrigerant leaving the impeller is more than the diffuser can handle and the flow becomes choked at the diffuser throat. At lower flow rates, on the other hand, the flow of refrigerant moving through the diffuser becomes unstable and a partial flow reversal takes place producing noise and a dramatic reduction in machine efficiency. Eventually a complete reversal in flow is experienced whereupon the compressor stalls or surges. The range between a choke condition and the onset of a surge condition generally defines the operating range of the machine. In a compressor relying solely upon the inlet guide vanes for capacity control, this range is narrow, particularly when vanes are used in the diffuser.

Since a wide range of volumetric flow rates is desirable in many compressor applications, numerous modifications have been suggested to improve flow stability at low volumetric flow rates. As explained above, the prior art has attempted to control surge in centrifugal compressors by providing variable guide vanes that control the flow of refrigerant through the compressor. While this technique has helped, it has not been completely effective, as fluid flow through the diffuser accounts for most of the conditions that cause surge.

U.S. Pat. No. 5,807,071 issued to Brasz et al., which is incorporated herein by reference, discloses a variable geometry pipe diffuser for a centrifugal compressor that provides improved control of compressor performance under changing loads, to thus avoid instances of surge. The variable diffuser includes inner and outer rings having complementary inlet flow channel sections formed therein. The inner and outer rings are rotatable with respect to one another, thereby allowing for the adjustment of fluid flow through the flow channels.

While the variable diffuser disclosed in Brasz et al. provides a significant improvement in the art, it attempts to solve the surge problem independently of the variable guide vanes of the compressor. Specifically, the guide vanes and the diffuser are adjusted independently of one another, and this independent adjustment is incapable of maintaining maximum efficiency and avoiding surge completely. There still remains, therefore, a need for an efficient manner of controlling interaction between variable guide vanes and the variable diffuser of a centrifugal compressor in order to avoid instances of surge under changing load conditions.

SUMMARY OF THE INVENTION

Therefore, it is an object of the present invention to provide a method and apparatus for controlling the amount of gas flow through a compressor by controlling interaction between the variable guide vanes and variable diffuser of the compressor to maintain optimum compressor performance over a broad range of load conditions.

In accordance with one embodiment of the present invention, the method of controlling the amount of gas flow through a compressor having at least one variable geometry guide vane and a variable geometry diffuser includes the steps of (1) detecting the geometry of the guide vane and (2) adjusting the geometry of the diffuser based on the geometry of the guide vane.

In a preferred embodiment, the adjusting step is based only on the geometry of the guide vane.

In another preferred embodiment, the method includes the additional step of establishing a peak performance relationship between guide vane geometry and diffuser geometry, and using the relationship to carry out the adjusting step. Preferably, the establishing step includes selecting a plurality of load points from a lift versus load surge plot, and determining a corresponding plurality of control point pairs, each pair representing guide vane and diffuser geometries necessary to establish the peak performance relationship. More preferably, the method further includes the step of calculating a diffuser geometry value, DPV, using the relationship of the establishing step. Most preferably, the method includes the step of comparing the calculated diffuser geometry, DPV, to a diffuser geometry, DFMAX, that allows maximum gas flow through the compressor, and adjusting the diffuser to a minimum default position when DPV is less than a predetermined percentage of DFMAX.

The apparatus in accordance with a preferred embodiment of the present invention includes a first actuator for controlling the geometry of the guide vane, a second actuator for controlling the geometry of the diffuser, and a controller for adjusting the geometry of the diffuser based on the geometry of the guide vane.

These and other objects of the present invention will be better understood by reading the following detailed description in combination with the attached drawings of a preferred embodiment of the invention.

BRIEF DESCRIPTION OF THE DRAWINGS

In the drawings, wherein like numerals are used to indicate the same elements throughout the views.

DETAILED DESCRIPTION OF THE INVENTION

Figure 1:
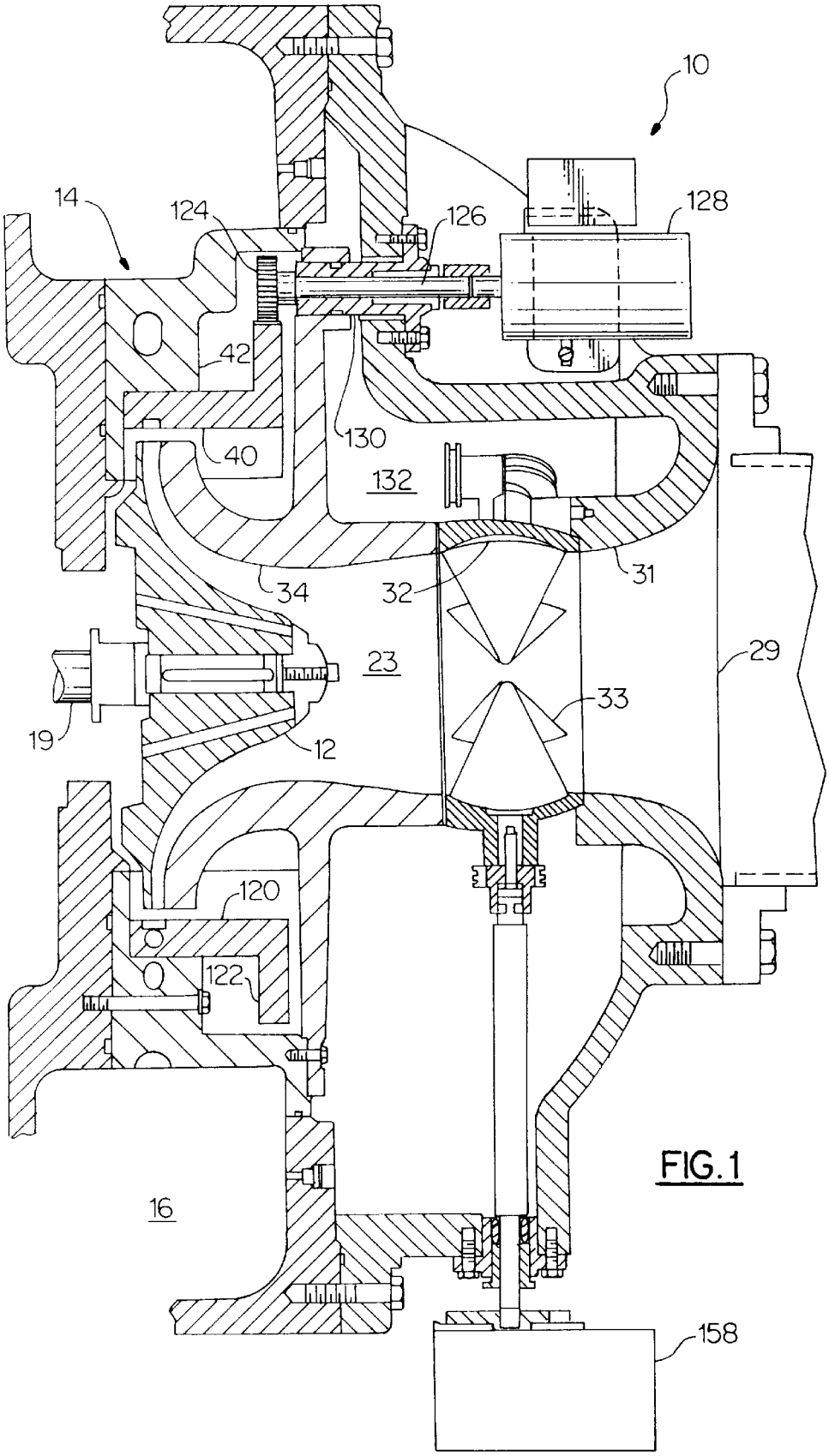
FIG. 1 is a cross-sectional side view of a compressor having a split ring diffuser.

A basic compressor structure will be described with reference to FIG. 1 and the specific components shown therein. These components are shown and described in Brasz et al. U.S. Pat. No. 5,807,071 and operate as described in that patent. It is understood that various other types of components could also be used in connection with the present invention. For example, while a split-ring diffuser is shown in FIG. 1 any type of variable geometry diffuser could be used.

As explained in Brasz et al., the efficiency of a compressor can often be optimized by combining an adjustment of guide vanes 33 with an independent adjustment of diffuser rings 40 and 42. Simple mechanical apparatuses for rotating guide vanes 33 and for rotating inner ring 40 circumferentially within outer ring 42 are described with reference again to FIG. 1. An actuator 158 is connected to guide vanes 33 to change the geometry of the guide vanes (e.g., by rotating the guide vanes) and thus adjust the flow-through area thereof. With respect to diffuser 14, a cylinder 120 integral with the inner ring 40 extends coextensively from inner ring 40 and has fixedly attached thereto a flange 122 which extends radially outwardly from the cylinder 120. In gearing relation with flange 122 is gear 124 which is driven via axle 126 by an actuator 128.

Both actuators 128 and 158 are of a known type and include electric motors for rotating the guide vanes and split rings, respectively. The amount of current supplied to each motor represents the degree to which each motor will open or close the guide vanes or diffuser. For example, a minimum of 4 mA may be required to move the diffuser to 5% open, while 20 mA may be required to move the diffuser to 100% open. A subsequent signal of less than 20 mA would close the diffuser a corresponding percentage.

The manner in which actuator 128 is selected and controlled to effect movement of the inner ring 40 in relation to the outer ring 42 between the fully open and closed positions and any number of intermediate positions therebetween, and the interaction of the diffuser 14 with guide vanes 33 will now be explained.

Figure 2:
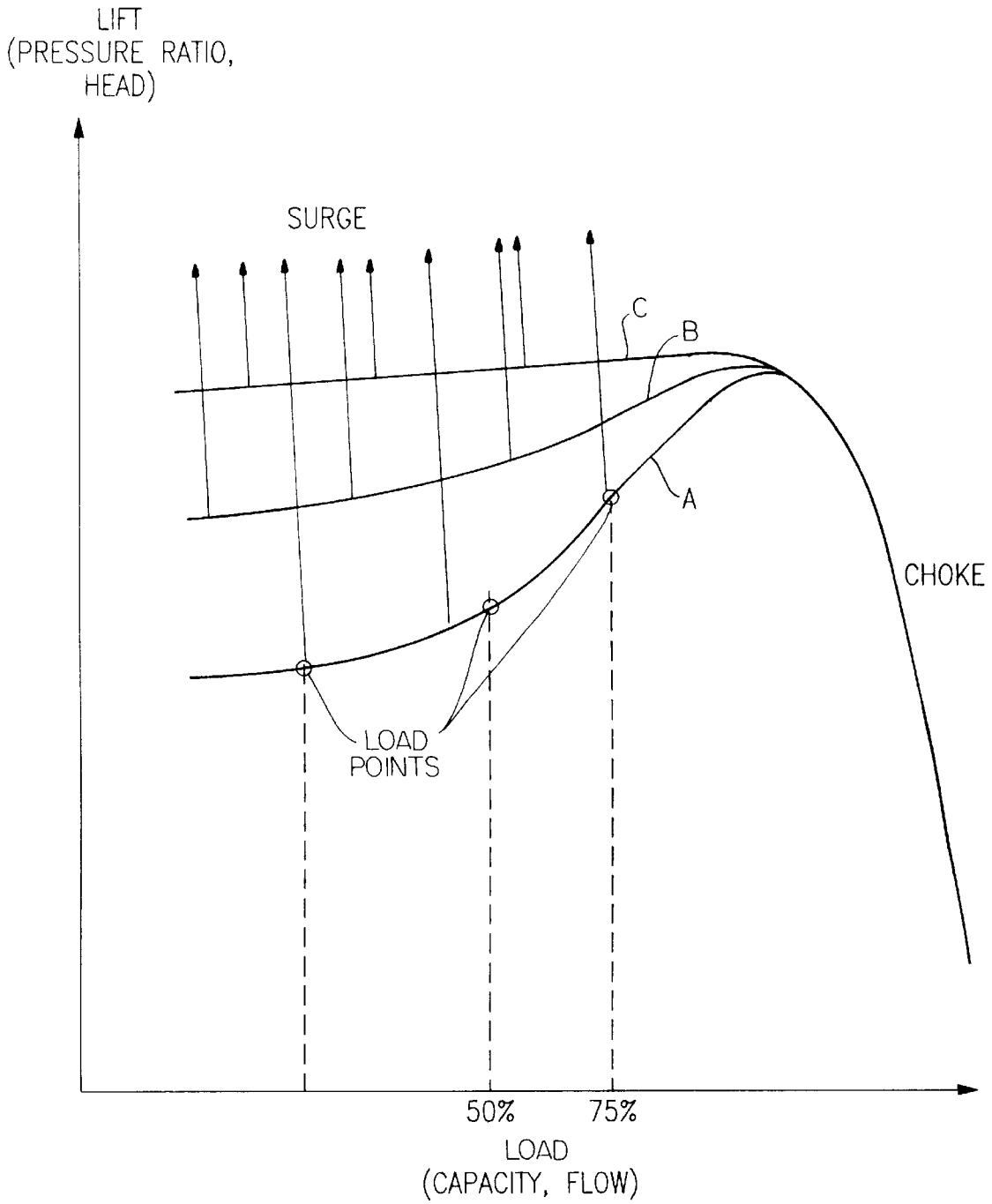
FIG. 2 shows various load versus lift lines for different geographic regions.

It is well established that the performance of a compressor can be represented graphically using load versus lift plots, such as shown in FIG. 2. Additionally, the required load/lift conditions for different geographic regions can be established easily using historic data. Required load lines are shown in FIG. 2 for different geographic regions. For example, the lower load line might be a line for the United States where humidity levels are relatively low, whereas the higher load line might be a line for Asia where humidity levels are relatively high. The compressor will go into surge if it operates above any of the required load lines shown in FIG. 2. Conversely, the compressor will be less than optimally efficient if it operates below the required load lines shown in FIG. 2. Therefore, it is desirable to have the compressor maintain peak performance while avoiding surge on any possible load/lift line. In accordance with the present invention, this is accomplished by controlling the position of the variable geometry diffuser 14 solely dependent on the position of guide vanes 33.

Figure 3:
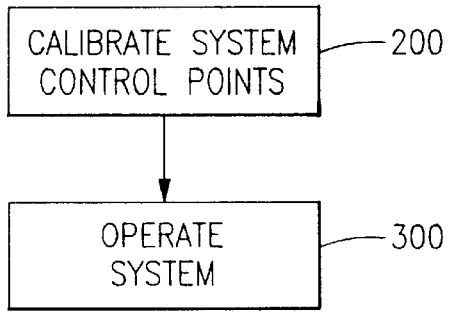
FIG. 3 shows a flow diagram explaining the method of the present invention.

The method of the present invention is accomplished according to FIG. 3. The system is first calibrated by determining a number of control points according to step 200, which is shown in more detail in FIG. 4. Next, the system operates to have the position of the variable geometry diffuser 14 function in direct correlation to the fluid flow through guide vanes 33 according to step 300, which is shown in more detail in FIG. 5.

Figure 4:
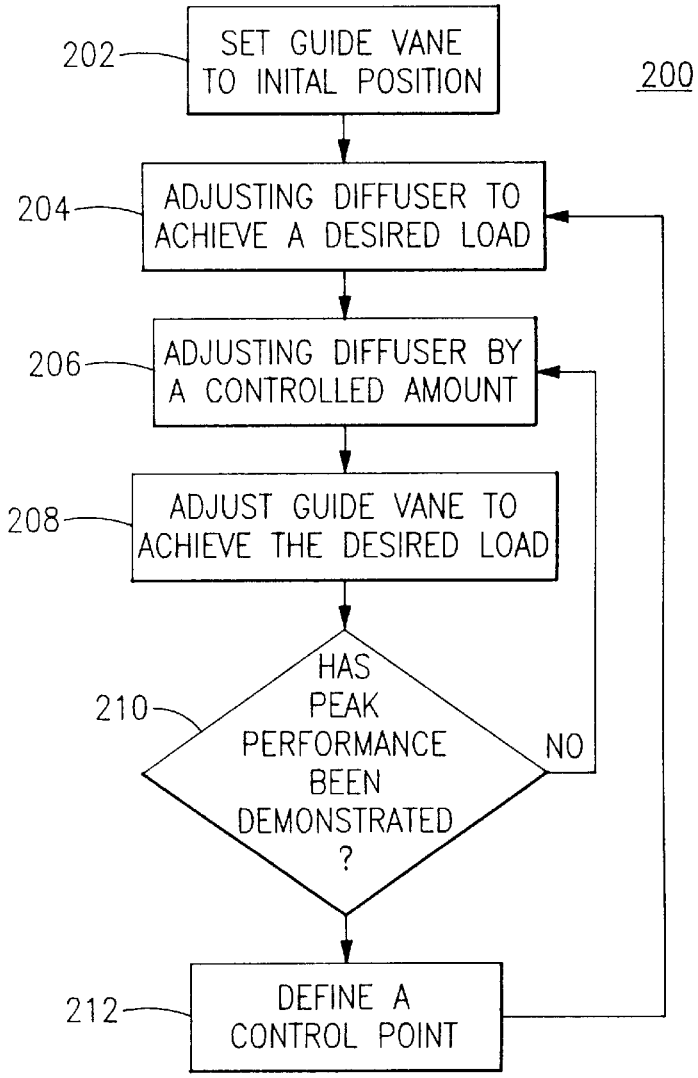
FIG. 4 shows a flow diagram for determining a plurality of control points.

The calibration routine 200 is shown in more detail by the flow chart of FIG. 4. The calibration routine is used to determine a number of control points defining peak performance on any load/lift line of compressor 10. Control points include guide vane load points (e.g., GV1, GV2 and GV3) and diffuser load points (e.g., DF1, DF2 and DF3) and each is representative of a percentage of the fully open positions of the guide vanes and diffuser, respectively. A control point is determined when the performance of the system is optimum or when further adjustment of guide vanes 33 or diffuser 14 results in a potential for detrimental mechanical performance, such as the event of surge or rotating stall. The procedure for defining the control points will now be explained with reference to the flow diagram in FIG. 4.

First, in step 202, guide vanes 33 are set to an initial position (GVMAX, FIG. 6) and diffuser 14 is set to an initial position (DFMAX, FIG. 6), both of which allow maximum gas flow through compressor 10. In step 204, the geometry of diffuser 14 is adjusted to control gas flow therethrough until the desired load (e.g., 75% in FIG. 2) is achieved. In such a condition, the compressor 10 will have the highest possible surge margin. Next, diffuser 14 is opened by a controlled amount (e.g., 5%) and guide vanes 33 are closed until the previously mentioned desired load is obtained as shown in steps 206 and 208. FIG. 4 shows that these steps are repeated as necessary, until a limit is reached as shown by the loop formed by steps 206, 208 and 210. The optimum is reached when the next iteration shows either lower efficiency and/or surge and/or rotating stall.

In one embodiment, this peak performance is determined at three load points as shown in FIG. 2. The three load points correspond, for example, to a 25%, 50% and 75% load. At these three load points, guide vanes 33 and diffuser 14 are adjusted so that the compressor is operating at peak performance on the required load line.

Once peak performance is established, the position of guide vanes 33 and diffuser 14 are recorded as a first pair of control points. For example, reference can be made to GV3 and DF3, respectively, in FIG. 6. Successive pairs of control points at lower loads may be determined by repeating steps 202–212, except that the initial setting of guide vanes 33 in step 202 is matched to the optimum setting (e.g., GV3) determined from the previous pair of control points. Any number of control points may be defined in this way. From these control points, the optimum operating relationship between the flow through guide vanes 33 and the flow through diffuser 14 is established, and can be represented graphically, as shown in FIG. 6.

Figure 6:
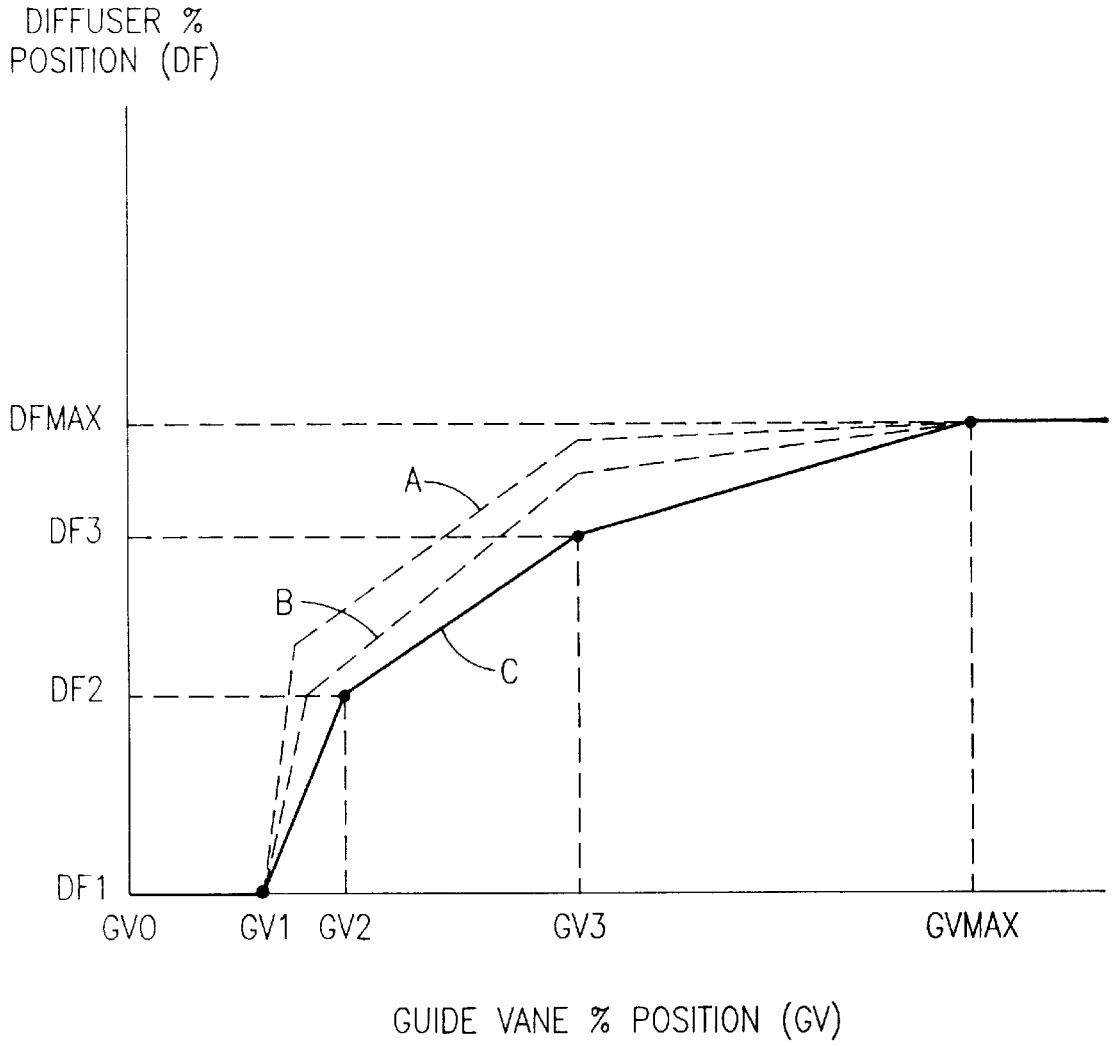
FIG. 6 is a graph that displays the optimum performance for a compressor based on guide vane positioning and diffuser positioning.

The graph in FIG. 6 includes first, second and third guide vane control points (GV1, GV2and GV3, respectively), which correspond to optimal diffuser control points (DF1, DF2 and DF3, respectively). Additional intermediate guide vane and diffuser control points can be determined, depending upon the number of times the process of step 200 is repeated.

The control points shown in FIG. 6 are defined for an individual system load/lift line. The various control points are defined between those where surge occurs at high flow and lift (e.g., GV3, DF3) to those where surge occurs at relatively low flow and lift (e.g., GV1, DF1), approaching the lowest-lift surge condition where guide vanes 33 are variable while the diffuser 14 is fixed (i.e., the region from GV1 to GV0). Selection of which control points to use for a particular operating point depends on the load and lift being demanded of the system, which are determined from the measurement of the system pressures and temperatures. Again, these factors will vary depending upon climate, as explained above with reference to FIG. 2.

With reference to FIG. 2, load line A is an example of a load line for a geographic area such as the United States and corresponds to line A of FIG. 6. Likewise, load line C is an example of a load line for a geographic area such as Asia and corresponds to line C of FIG. 6. It is important to note that by combining the calibration method of FIG. 4 with the load lines of FIG. 2, it is straightforward to determine a number of control points to create the lines of FIG. 6. Whether the lines are connected in a point to point fashion or in an arc like fashion is a matter of what degree of accuracy is desired for establishing a relationship between guide vane 33 position and a diffuser 14 position.

Figure 5:
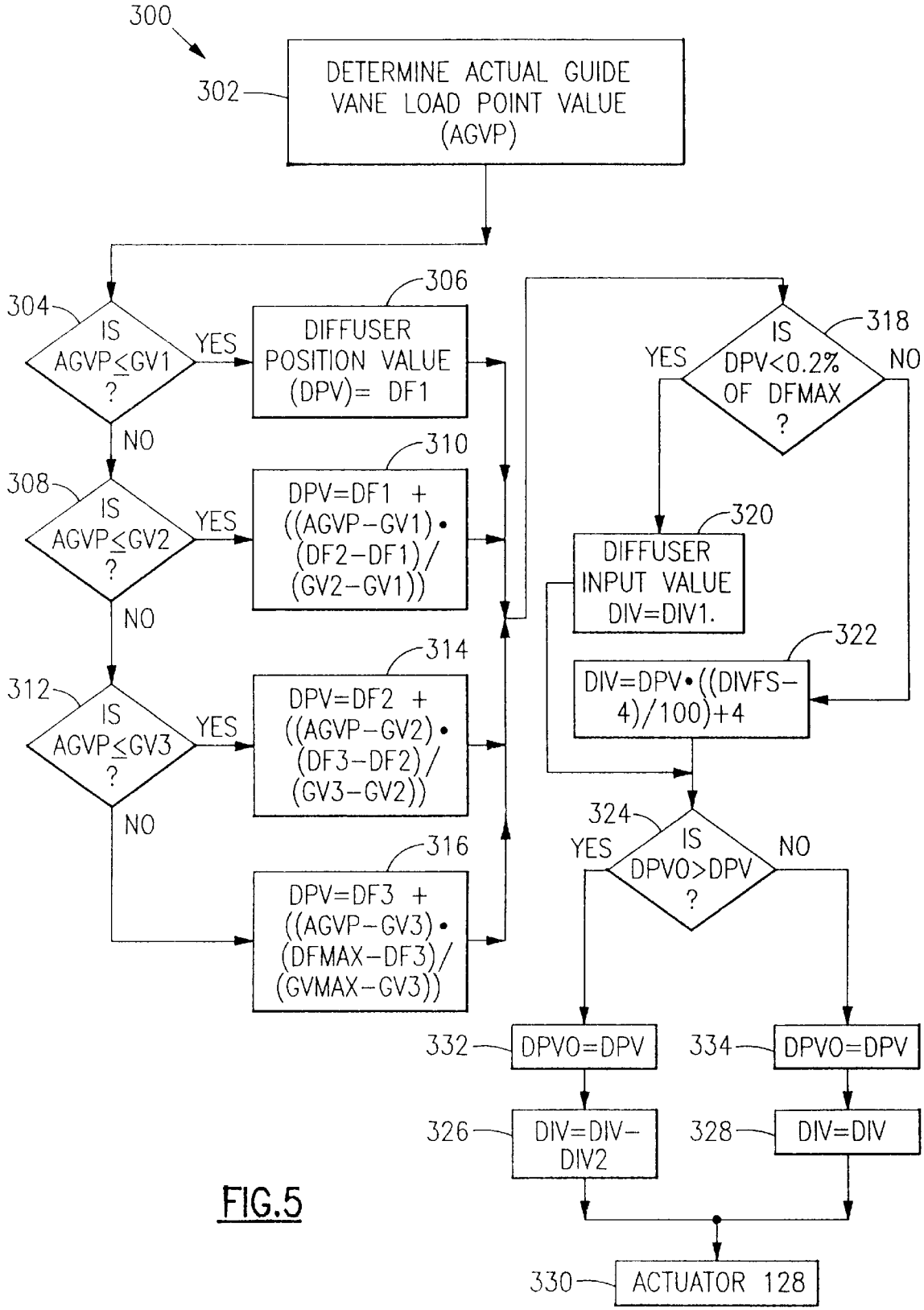
FIG. 5 shows a flow diagram for determining a position control input for controlling the position of a diffuser.

FIG. 5 shows a flow diagram of the operation subroutine 300, for operating the system once the control points of step 200 have been established.

Before subroutine 300 can be run, however a number of initial default values are input into the control system of the present invention. A first diffuser input value (DIV1) is set to a predetermined value (e.g., 2 mA) representative of the magnitude of current signal supplied to actuator motor 128 to close diffuser 14 (DF1, FIG. 6). Although it is stated that the diffuser 14 is closed, in fact, for safety reasons the diffuser 14 never actually fully closes due to the presence of a mechanical stop. A second diffuser input value (DIV2) is set and is representative of the amount of current that will be used to adjust for gear-induced hysteresis (explained below) when the compressor is operating. A first predetermined guide vane load point (GVMAX, FIG. 6) represents the maximum open position of guide vanes 33. A first predetermined diffuser load point (DFMAX, FIG. 6) represents the maximum open position of diffuser 14. An initial diffuser position value (DPV0) preferably is set equal to zero. The initial diffuser position value (DPV0) will change as the system is operating and is used to determine whether or not to adjust for hysteresis, as will be explained below. Finally, a diffuser full span input (DIVFS) is set to the value of the maximum current that will cause the actuator to move the diffuser to the maximum open position (DFMAX). Referring again to FIG. 5, in step 302, the actual position of guide vanes 33 is detected (by detecting the current supplied to actuator 158), recorded as a percentage of GVMAX, and given an actual guide vane load point (AGVP)(%).

Step 304 determines a diffuser position value (DPV) by comparing the actual guide vane load point (AGVP) to the first guide vane control point (GV1). If the actual guide vane load point (AGVP) is less than or equal to the first guide vane control point (GV1), then a diffuser position value (DPV) is set equal to the first diffuser control point (DF1) as determined by a first formula shown in step 306, which is labeled as equation (1) below.

$$DPV = DF1 \tag{1}$$

In step 308, if the actual guide vane load point (AGVP) is greater than the first guide vane control point (GV1) and less than or equal to the second guide vane control point (GV2), then the diffuser position value (DPV) is determined by a second formula. The second formula, shown in step 310, is:

$$DPV = DF1 + \left(\frac{(AGVP - GV1)\cdot(DF2\cdot DF1)}{(GV2 - GV1)}\right) \tag{2}$$

In step 312, if the actual guide vane load point (AGVP) is greater than the second guide vane control point (GV2) and less than or equal to the third guide vane control point (GV3), then the diffuser position value (DPV) is determined by a third formula. The third formula, shown in step 314, is:

$$DPV = DF2 + \left(\frac{(AGVP - GV2)\cdot(DF3\cdot DF2)}{(GV3 - GV2)}\right) \tag{3}$$

In step 312, if the actual guide vane load point (AGVP) is greater than the third guide vane control point (GV3), then the diffuser position value (DPV) is determined by a fourth formula. The fourth formula, shown in step 316, is:

$$DPV = DF3 + \left(\frac{(AGVP - GV3)\cdot(DF\mathrm{MAX}\cdot DF3)}{(GV\mathrm{MAX} - GV3)}\right) \tag{4}$$

Each of formulas 2–4 interpolates a DPV from the graph in FIG. 6. A more precise algebraic relationship could be established in which case steps 304–316 would be replaced with a functional formula of DF and GV.

After the diffuser position value (DPV) is determined by one of the above steps, the diffuser position value is then compared to a percentage of DFMAX, shown in step 318, in order to determine a value for the diffuser input value (DIV (mA)), which will be supplied to motor 128 to control the position of diffuser 14 and, accordingly, the flow of gas therethrough. Although any percentage may be used in step 318, the present embodiment determines whether the diffuser position value (DPV) is less than 0.2% of DFMAX, and if so, then the diffuser input value (DIV) is set equal to the first diffuser input value (DIV1), shown in step 320, which will cause the actuator 128 to move the diffuser 14 into the "fully closed" position. If the diffuser position value (DPV) is greater than or equal to 0.2% of DFMAX, then the diffuser input value (DIV) is determined according to step 322 by equation (5):

$$DIV = DPV\cdot\left(\frac{(DIVFS - 4)}{100}\right) + 4 \tag{5}$$

For example, if DIVFS is 20 mA and AGVP corresponds to a DPV of 90% of DFMAX, then formula 5 would result in $$DIV = 90\left(\frac{(20 - 4)}{100}\right) + 4 = 18.4\,mA.$$

Thus, in a condition where DPV=90%, for example, 18.4 mA of current would be supplied to actuator 128 to open diffuser 14 to a position 90% of fully open (DFMAX).

Hysteresis is accounted for and corrected in steps 324, 326, 328, 332 and 334. Hysteresis is caused, for example, by the clearance between the gear teeth of gear 124 driven by actuator 128 and the gear teeth formed in flange 122 of inner ring 40. Such clearance is necessary to allow the teeth of one gear to fit into the gap of another gear. Without these size differences, the teeth of one gear would not be able to fit inside the gap of another gear and there would be no movement.

Hysteresis occurs when a gear shifts directions thus driving a second gear in the opposite direction. The teeth of the first gear are contacting a different edge that forms the gap of the second gear when moving in an opposite direction. This small space between tooth and gap is the hysteresis value that must be accounted for when sending control signals to actuator 128.

In step 324, the initial diffuser position value (DPV0) is compared to the diffuser position value (DPV) and, if the initial diffuser position value (DPV0) is greater than the diffuser position value (DPV), then the diffuser input value (DIV) is adjusted according to step 326 and the following formula:

$$DIV=DIV-DIV2 \quad (6)$$

Otherwise, the diffuser input value (DIV) remains unchanged as shown in step 328.

In steps 332 and 334, the initial diffuser position value (DPV0) is adjusted to equal the diffuser position value (DPV). In step 330, the diffuser input value (DIV) is transmitted to actuator 128 that, in the specific embodiment described herein, adjusts the position of ring 40 relative to ring 42. Steps 302 through 334 are now repeated at timed intervals, until the system is reset. Although any timed interval may be used, the present embodiment employs timed intervals of 5 seconds.

While the present invention has been described with reference to a particular preferred embodiment, it will be understood by those skilled in the art that various modifications and the like could be made thereto without departing from the spirit and scope of the invention as defined in the following claims.

We claim:

1. A method of controlling the amount of gas flow through a compressor having plurality of variable geometry guide vanes and a variable geometry diffuser, said method comprising;

detecting the geometry of said plurality of guide vanes;

adjusting the geometry of said diffuser based on the geometry of said plurality of guide vanes;

establishing a peak performance relationship between guide vane geometry and diffuser geometry, and using said relationship to carry out said adjusting step, wherein said establishing step comprises selecting a plurality of load points from a lift versus load plot, and determining a corresponding plurality of control point pairs, each pair representing guide vane and diffuser geometries necessary to establish the peak performance relationship.

2. A method of controlling the amount of gas flow through a compressor having plurality of variable geometry guide vanes and a variable geometry diffuser, said method comprising:

detecting the geometry of said plurality of guide vanes;

adjusting the geometry of said diffuser based on the geometry of said plurality of guide vanes;

establishing a peak performance relationship between guide vane geometry and diffuser geometry, and using said relationship to carry out said adjusting step;

calculating a diffuser geometry value, DPV, using the relationship of aid establishing step; and comparing the calculated diffuser geometry, DPV, to a diffuser geometry, DFMAX, that allows maximum gas flow through the compressor, and adjusting the diffuser to a minimum default position when DPV is less than a predetermined percentage of DFMAX.

3. An apparatus for controlling gas through a compressor having a variable geometry diffuser and plurality of variable geometry guide vanes, said apparatus comprising:

a first actuator for controlling the geometry of said plurality of guide vanes;

a second actuator for controlling the geometry of said diffuser;

a controller for adjusting the geometry of said diffuser based on the geometry of said guide vane, wherein said controller comprises storage means for storing a relationship between guide vane geometry and diffuser geometry, and uses said relationship to adjust the geometry of said diffuser based on the geometry of said guide vane, and wherein said controller further comprises calculation means for calculating a diffuser geometry value, DPV, using the relationship stored in said storage means; and comparison means for comparing DPV to a diffuser geometry, DFMAX, that allows maximum gas flow through the compressor, wherein said second actuator adjusts the diffuser to a minimum default position when DPV is less than a predetermined percentage of DFMAX.

4. A method for determining a position control input for controlling the amount of flow through a diffuser in a compressor, said compressor includes a variable geometry diffuser and plurality of variable geometry guide vanes, said method comprising:

determining a plurality of control points;

establishing a plurality of diffuser position value formulas for determining a diffuser position value, said diffuser position value formulas being a function of said plurality of control points;

establishing a plurality of diffuser position control input formulas;

detecting a measured position of said plurality of guide vanes;

selecting one of said plurality of diffuser position value formulas based on the position of said plurality of guide vanes, wherein said selecting a diffuser position value formula step includes selecting a second diffuser position value formula if said position of said plurality of guide vanes is above said first predetermined value and at or below a second predetermined value;

selecting one of said plurality of diffuser position control input formulas based on the diffuser position value; and calculating said position control input based on said selected diffuser control input formula.

5. The method according to claim 4, wherein said selecting a diffuser position value step includes selecting a third diffuser position value formula if said position of said plurality of guide vanes is above said second predetermined value and at or below a third predetermined value.

6. The method according to claim 5, wherein said selecting a diffuser position value step includes selecting a fourth diffuser position value formula if said position of said plurality of guide vanes is above said third predetermined value.

7. An apparatus for controlling gas through a compressor having a variable geometry diffuser and plurality of variable geometry guide vanes, said apparatus comprising:

a first actuator for controlling the geometry of said plurality of guide vanes;

a second actuator for controlling the geometry of said diffuser;

a controller for adjusting the geometry of said diffuser based on the geometry of said guide vane, wherein said controller comprises storage means for storing a relationship between guide vane geometry and diffuser geometry, and uses said relationship to adjust the geometry of said diffuser based on the geometry of said guide vane, wherein said controller further comprises calculation means for calculating a diffuser geometry value, DPV, using the relationship stored in said storage means, wherein said calculating step includes determining a diffuser position value formula, selecting a diffuser position control input formula by comparing the diffuser position value to a percentage of a diffuser position value when the diffuser is in a fully open position, and then determining the diffuser control input from said selected diffuser position control input formula.

* * * * *